US009862114B2

(12) United States Patent
Schmeiser

(10) Patent No.: US 9,862,114 B2
(45) Date of Patent: Jan. 9, 2018

(54) SLICING APPARATUS

(71) Applicant: Weber Maschinenbau GmbH Breidenbach, Breidenbach (DE)

(72) Inventor: Jörg Schmeiser, Wiggensbach (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 143 days.

(21) Appl. No.: 15/065,127

(22) Filed: Mar. 9, 2016

(65) Prior Publication Data

US 2016/0263764 A1 Sep. 15, 2016

(30) Foreign Application Priority Data

Mar. 12, 2015 (DE) ..... 10 2015 103 648

(51) Int. Cl.
*B26D 7/18* (2006.01)
*B26D 7/32* (2006.01)
*B26D 7/06* (2006.01)

(52) U.S. Cl.
CPC ..... *B26D 7/18* (2013.01); *B26D 7/0625* (2013.01); *B26D 7/32* (2013.01); *B26D 2210/02* (2013.01); *Y10S 83/932* (2013.01)

(58) Field of Classification Search
CPC ..... B26D 7/18; B26D 7/0625; B26D 7/32; B26D 2210/02; B26D 2210/00;
(Continued)

(56) References Cited

U.S. PATENT DOCUMENTS 3,774,748 A * 11/1973 Dederer ..... B65G 47/681 198/444
4,846,336 A * 7/1989 Hoyland ..... B65G 47/084 198/432
(Continued)

FOREIGN PATENT DOCUMENTS

DE 19914707 A1 10/2000
DE 102013207873 A1 11/2014
(Continued)

OTHER PUBLICATIONS

German Search Report of DE 10 2015 103 648.7 dated Feb. 25, 2016.

*Primary Examiner* — Phong Nguyen
(74) *Attorney, Agent, or Firm* — Wiggin and Dana LLP; Gregory S. Rosenblatt; Jonathan D. Hall

(57) ABSTRACT

A slicing apparatus for a continuous slicing of products comprises a slicing unit having a movable cutting blade, a supply apparatus for a multi-track supply of the products to the slicing unit to cut off slices from the products and a removal apparatus for removing portions of cut-off slices along a transport direction. The removal apparatus has a first removal conveyor and a second removal conveyor arranged downstream of the first removal conveyor with respect to the transport direction. The slicing apparatus comprises a slicing apparatus provided between the first removal conveyor and the second removal conveyor for cut-off product parts to be discarded and a track combiner which is configured to take over portions not to be discarded in each case from a number of different conveyor tracks of the first removal conveyor consecutively in time and to combine them in a smaller number of tracks on the second removal conveyor.

9 Claims, 1 Drawing Sheet

(58) Field of Classification Search
CPC . Y10T 83/04; Y10T 83/0448; Y10T 83/0467; Y10T 83/0505; Y10T 83/2044; Y10T 83/2074; Y10T 83/2083; Y10T 83/2085; Y10T 83/2087; Y10T 83/2098; Y10T 83/2192; Y10T 83/2194; Y10T 83/463; Y10T 83/4632; Y10T 83/478; Y10T 83/4789; Y10S 83/932
USPC ..... 198/448
See application file for complete search history.

(56) References Cited

U.S. PATENT DOCUMENTS

| | | | | |
|---|---|---|---|---|
| 5,944,165 | A * | 8/1999 | Mannlein | B65G 47/71 198/367 |
| 6,640,681 | B1 | 11/2003 | Weber | |
| 7,717,251 | B2 * | 5/2010 | Glas | B65G 47/681 198/369.1 |
| 8,820,202 | B2 * | 9/2014 | Schaub | B26D 7/30 83/23 |
| 2004/0016331 | A1 | 1/2004 | Wolcott et al. | |
| 2009/0173196 | A1 | 7/2009 | Lindee et al. | |
| 2010/0025189 | A1 * | 2/2010 | Muller | B65H 29/6681 198/418.1 |
| 2012/0180438 | A1 | 7/2012 | Lagares Corominas | |

FOREIGN PATENT DOCUMENTS

| | | | |
|---|---|---|---|
| EP | 0820943 | A1 | 1/1998 |
| EP | 2420364 | A1 | 2/2012 |
| WO | 2004011209 | A1 | 2/2004 |
| WO | 2010125441 | A1 | 11/2010 |

* cited by examiner

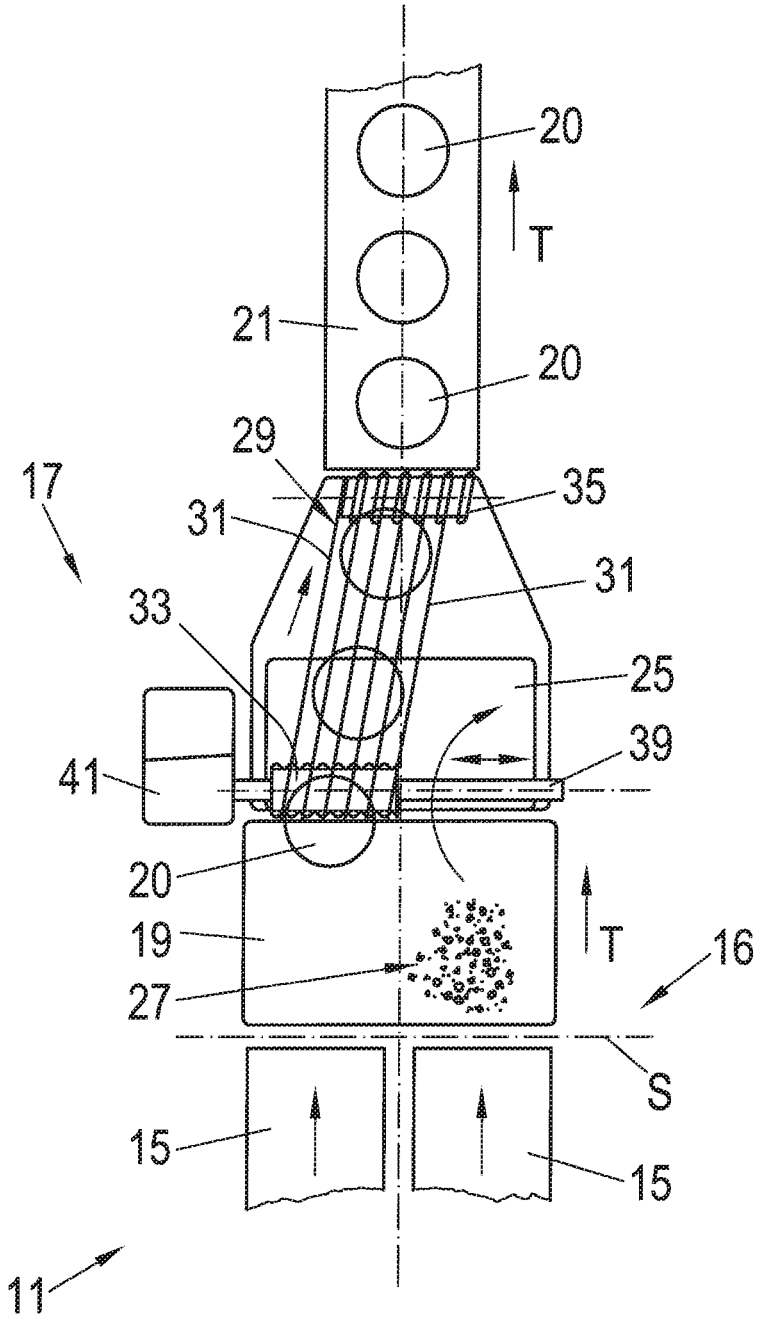
20
T
21
20
29
35
17
31
31
33
25
39
41
20
19
T
16
27
S
15
15
11

SLICING APPARATUS

The present invention relates to a slicing apparatus, in particular to a high-performance slicer, for the continuous slicing of products, in particular food products, having at least one slicing unit which comprises a movable cutting blade, having a supply apparatus for the multi-track supply of the products to the slicing unit to cut off the slices from the products, and having a removal apparatus for removing respective portions comprising at least one cut-off slice along a transport direction, wherein the removal apparatus has a first removal conveyor and a second removal conveyor arranged downstream of the first removal conveyor with respect to the transport direction.

Such slicing apparatus are used, for example, for the automatic slicing of sausage products or cheese products at a high cutting rate. Breaks or interruptions in the product flow which may arise due to the loading of the apparatus with new product bars or product loaves are disadvantageous in this respect. There are no such breaks with a continuous slicing which can be achieved, for example, by alternate slicing of a plurality of products in different conveying tracks.

After a loading with a new product, the unusable first cut first has to be expelled from the removal path before normal portions can again be removed on the corresponding conveyor track. Equally, the product remainder present at the end of a product bar or product loaf has to be expelled from the removal path. Portions of incorrect weight, snippets and the like also have to be expelled at times. This can e.g. be effected using a conveyor configured as a rocker which is tilted downward as required and in so doing ejects the product material to be discarded.

The provision of such a rocker, including the associated control, is, however, very complex and expensive. In addition, the conveyor path and thus the installation space is extended. Another possibility for expelling comprises temporarily operating the conveyor provided for portioning backward. The respective conveyor would in this case have to be operable on an individual track basis, which is likewise associated with a relatively high effort and/or cost.

It is an object of the invention to allow a reliable expulsion of unusable product parts using simple means with a continuously operating slicing apparatus without Impairing the efficiency of the system.

The object is satisfied by a slicing apparatus, in particular by a high-performance slicer, for a continuous slicing of products, in particular food products, the slicing apparatus comprising:

- at least one slicing unit which comprises a movable cutting blade;
- a supply apparatus for the multi-track supply of the products to the slicing unit to cut off slices from the products; and
- a removal apparatus for removing respective portions comprising at least one cut-off slice along a transport direction, wherein the removal apparatus has a first removal conveyor and a second removal conveyor arranged downstream of the first removal conveyor with respect to the transport direction. The invention is characterized by a slicing apparatus provided between the first removal conveyor and the second removal conveyor for cut-off product parts to be discarded; and by a track combiner which is configured to take over respective portions not to be discarded from a number of different conveyor tracks of the first removal conveyor consecutively in time and to combine them in a smaller number of tracks on the second removal conveyor.

In accordance with the invention, a discarding device for cut-off product parts to be discarded is provided between the first removal conveyor and the second removal conveyor. The invention furthermore provides a track combiner which is configured to take over respective portions not to be discarded from a number of different conveyor tracks of the first removal conveyor consecutively in time and to combine them in a smaller number of tracks on the second removal conveyor so that a continuous product stream is present there.

Instead of therefore conducting the unusable product parts directly into a reject zone, the usable products are—conversely so-to-say—led away across the discarding device and are thus conducted past it. The discarding device can be a simple ejection opening through which the product parts to be discarded drop. However, conveyors moving e.g. transversely to the transport direction could also form the discarding device. Such a conveyor can convey away the product parts dropping onto it, optionally beneath the track combiner, and e.g. eject them to the side. The product parts dropping down or ejected can be collected in a reject container.

Due to the arrangement of the discarding device and the track combiner bridging it, neither a complex and/or expensive rocker nor a split portioning conveyor connected upstream is required so that the manufacturing effort and/or cost of a slicing apparatus in accordance with the invention is comparatively small. The total structure is in addition simple and the construction compact. An arrangement of the discarding device and the track combiner bridging it is also favorable in a hygienic aspect. An apparatus in accordance with the invention is in particular easy to clean.

The first removal conveyor can be arranged directly after the slicing unit and in particular directly after the associated cutting blade. This is, however, not absolutely necessary. The discarding device can be arranged directly behind the first removal conveyor, with this also not being absolutely necessary. For example, a weighing device could be arranged between the first removal conveyor and the discarding device. It is also possible that the discarding device in accordance with the invention is located at any desired point in a conveying system for food portions at which product streams from a plurality of sources are combined, i.e. led together. The plurality of sources can e.g. be different tracks of a single slicer or different slicers, e.g. each only working with one track.

Further developments of the invention can be seen from the dependent claims, from the description and from the enclosed drawing.

The track combiner can comprise a deflection conveyor whose conveying width is smaller by at least one conveyor track than the conveying width of all conveyor tracks of the first removal conveyor and whose end at the incoming side is displaceable transversely to the transport direction by at least one conveyor track. This allows a particularly simple construction.

The discarding device preferably extends, viewed transversely to the transport direction, at least substantially across all the conveyor tracks of the first removal conveyor. Product remainders on all conveyor tracks of the first removal conveyor can thus be expelled from the removal stream.

The length of the discarding device with respect to the transport direction is preferably larger than the length of a portion. This ensures a reliable discarding without "getting stuck". It is ensured by the indicated length with an ejection opening that there is sufficient space for the trajectory of the drop. In addition, repelling elements can be provided to direct product parts to be discarded downward in the region at the incoming side and/or to screen existing elements.

An embodiment of the invention provides that the track combiner is configured as a multi-belt conveyor having a plurality of individual conveyor belts. The conveyor belts are in this respect preferably designed as round belts. The allows a predefined interlacing over a relatively small path length.

In accordance with a further embodiment of the invention, the track combiner comprises a stationary deflection roller at the outgoing side and a drive roller displaceable transversely to the transport direction. The drive roller can in particular be designed in the manner of a sleeve and can be supported rotationally fixedly, but displaceably, on a rotatingly drivable carrier shaft. The drive roller can be in engagement with the carrier shaft, e.g. via a polygonal section, in a shape-matched manner for a drive-effective connection. Such a sleeve-like drive roller can be adjustable by means of an adjustment apparatus, which is in particular pneumatic, in the transverse direction. In principle, a reversal is conceivable in the sense that the drive roller is located at the outgoing side and the deflection roller at the incoming side is adjustable transversely to the transport direction.

In accordance with a specific embodiment of the invention, the first removal conveyor has two, three or four conveyor tracks, whereas the second removal conveyor only has one single conveyor track on which a continuous product stream comprising so-called good portions, that is portions having desired properties, is supplied to a downstream processing process, in particular to a packaging machine. These constellations cover a number of applications important in practice. The second removal conveyor is preferably arranged centrally with respect to the conveyor width at the incoming side.

The invention also relates to a method for the continuous slicing of products, in particular food products, wherein the products are supplied over multiple tracks to at least one slicing unit having a movable cutting blade to cut off slices from the products and wherein respective portions comprising at least one cut-off slice are removed along a transport direction on a first removal conveyor and on a second removal conveyor arranged downstream of the first removal conveyor with respect to the transport direction.

Provision is made in accordance with the invention that cut-of product parts to be discarded are supplied to a discarding device located between the first removal conveyor and the second removal conveyor and that portions not to be discarded are taken over in each case from a number of different conveyor tracks of the first removal conveyor consecutively in time and are combined in a smaller number of tracks on the second removal conveyor.

It can thereby be prevented that interruptions occur in the product flow due to the discarding of unusable product parts.

During the slicing of a first product on one of the tracks, another track is preferably loaded with a second or further product, wherein an unusable product start of the second or further product is cut off before the first product is completely sliced.

Provision can in particular be made that the product start of the second or further product is sliced into unusable first-cut parts by means of the cutting blade, with the slicing of the product start being started exactly when the usable product remainder of the first product is just sufficient for cutting off that number of slices which corresponds to a predefined number of unusable first-cut parts of the second or further product.

It can thereby be achieved that the last first-cut part is cut off on one track while, on another track, simultaneously the last usable slice and/or the last slice of a portion, in particular of a portion which is just completed by the last cut-off slice, is/are cut off. When the first product has been consumed or should not be sliced further for other reasons, it is therefore possible to start with the further cutting on the other track immediately and without interruption.

If otherwise the cutting off of the first-cut parts were to be started too early, the necessity would result of an unwanted retraction of the newly provided product from the cutting blade, in particular for the purpose of avoiding snippet formation.

The invention therefore generally provides the possibility that overall always only exactly usable slice is cut off with every cutting movement of the blade, i.e. with each blade passage or with each blade revolution, despite the multi-track operation and thus a blade passage or a blade revolution does not take place at any time by which a plurality of usable slices are cut off simultaneously, by which only one product part to be discarded is cut off or by which nothing at all is cut off, that is the blade makes a "blank cut". A simultaneous cutting off of a usable slice on one of the tracks and of a product part to be discarded on another one of the tracks is, in contrast, possible in accordance with the invention and is actually particularly advantageous in the sense of a continuous slicing by track combining with the possibility of a simultaneous disposal of first cuts.

The invention will be described in the following by way of example with reference to the drawing and shows in a single FIGURE a simplified plan view of a slicing apparatus in accordance with the invention.

A slicing apparatus 11 in the form of a high-performance slicer is shown in simplified form in the FIGURE. The slicing apparatus 11 comprises a supply apparatus which is not shown separately and which is configured for a two-track supply of food products 15 such as sausage bars or cheese loaves. The products 15 are delivered to a slicing unit 16 by means of the supply apparatus, with a cutting blade, not shown, of the slicing unit 16 moving in a rotating and/or revolving manner in the cutting plane S continuously cutting off slices from the products 15. The supply apparatus can have a loading apparatus which is configured for receiving the products 15 and which is adjustable between a loading position and a supply position.

The slicing apparatus 11 is configured for a continuous slicing of products 15, that is it is designed to produce a completely continuous product stream without loading interruptions and without similar situations reducing the throughput. The slicing apparatus 11 is furthermore configured to avoid a retraction of the products 15 from the cutting blade for the purpose of preventing snippet formation.

A removal apparatus 17 is provided for removing the cut-off slices in the form of portions 20 along a transport direction T, said removal apparatus having a two-track incoming conveyor 19 and a single-track outgoing conveyor 21 arranged downstream thereof with respect to the transport direction T. The incoming conveyor 19 and the outgoing conveyor 21 are each configured as band conveyors in the embodiment shown. The incoming conveyor 19 furthermore forms a portioning conveyor and the outgoing conveyor 21 is connected upstream of a packaging machine, with this, however, not necessarily having to be provided in this manner. In principle, a portion in 20 can comprise a single slice or an arrangement of a plurality of slices, e.g. stacked slices, overlapping slices or slices placed in a round shape.

A discarding device 25 for cut-off product parts 27 to be discarded is located between the incoming conveyor 19 and the outgoing conveyor 21. The cut-off product parts 27 to be discarded can be unusable remainders, first-cut slices, end pieces, defective portions, snippets or the like. The embodiment shown provides a simple ejector opening as the discarding device 25. A reject container, preferably removable, can be provided beneath the discarding device 25, which is however, not shown in the FIGURE.

The discarding device 25 extends, viewed transversely to the transport direction T, across both conveyor tracks of the incoming conveyor 19 and is longer than a portion 20, viewed in the transport direction T.

A single-track track combiner 29, likewise arranged between the incoming conveyor 19 and the outgoing conveyor 21, bridges the discarding device 25 and serves for the transfer of portions 20 not to be discarded from the incoming conveyor 19 onto the outgoing conveyor 21. The track conveyor 29 is designed as a deflection conveyor here and comprises an arrangement of a plurality of individual round belts 31 which are guided around a drive roller 33 and a deflection roller 35. While the deflection roller 35 is in a fixed position and, as shown, is aligned with the outgoing conveyor 21, the drive roller 33 is displaceable transversely to the transport direction T, as is indicated by the double arrow in FIG. 1. The drive roller 33 is specifically designed in the manner of a sleeve and is supported rotationally fixedly, but displaceably on a rotatingly drivable carrier shaft 39. The drive-effective connection between the sleeve-like drive roller 33 and the carrier shaft 39 can be established by shape matching, e.g. by a polygonal section. An adjustment apparatus 41, e.g. a pneumatic adjustment apparatus, is provided for the controlled movement of the drive roller 33. The portions 20 are shown as transparent for a better visibility of the track combiner 29. Portions 20 can be selectively fed to the outgoing conveyor 21 on the first or second conveyor tracks of the incoming conveyor 19 by adjusting the drive roller 33.

If a discarding of unusable product parts 27 is desired during the operation of the slicing apparatus 11, the drive roller 33 is positioned such that it is located in the region of the conveyor track remote from the product parts 27. The product parts 27 are then conveyed from the incoming conveyor 19 to the discarding device 25 and drop into the ejector opening. A conveying on of portions 20 can simultaneously take place on the other track during this process so that as a result a continuous product stream is produced on the outgoing conveyor 21 to the extent that the two tracks at the incoming side are therefore combined in only one single track on the outgoing conveyor 21.

When the slicing apparatus 11 is loaded with a new product 15 on a track, the slicing of its product start into first-cut parts is paused as required. The production of first-cut parts is rather in particular only started when the product remainder of the first product is still just sufficient for producing that number of slicers to produce or complete a portion which corresponds to a predefined number of unusable first-cut parts of the new product 15.

A control device, not shown in FIG. 1, is associated with the slicing apparatus 11 and controls the operating procedure and in particular the time interplay of the individual components.

In the embodiment shown, the slicing apparatus 11 is configured as a single multi-track slicer. Alternatively, the slicing apparatus could also comprise a plurality of mutually independent slicing units 16, including corresponding product supply devices, that is e.g. a plurality of (e.g. respective slicers which only work over one track and which therefore cannot process a plurality of products simultaneously) and in this manner allow a multi-track slicing.

An alternative embodiment of the invention provides that the incoming conveyor 19 has three or four conveyor tracks. The track combiner 29 can furthermore also be configured with multi-tracks as required. It is, however, desirable that the conveyor width of the track combiner 29 is smaller by at least one conveyor track than the conveyor width of all conveyor tracks of the incoming conveyor 19.

REFERENCE NUMERAL LIST

11 slicing apparatus
15 product
16 slicing unit
17 removal apparatus
19 incoming conveyor
20 portion
21 outgoing conveyor
25 discarding device
27 product parts
29 track combiner
31 round belt
33 drive roller
35 deflection roller
39 carrier shaft
41 adjustment apparatus
S cutting plane
T transport direction

The invention claimed is:

1. A slicing apparatus for a continuous slicing of products, the slicing apparatus comprising:

at least one slicing unit having a movable cutting blade;

a two-track supply apparatus for supplying the products to the slicing unit to cut off the products into slices and discarded product parts;

a removal apparatus for removing the slices and the discarded product parts along a transport direction, the removal apparatus provided after the at least one slicing unit along the transport direction;

wherein the removal apparatus has a first removal conveyor and a second removal conveyor arranged downstream of the first removal conveyor with respect to the transport direction;

wherein the at least one slicing unit is provided between the first removal conveyor and the two-track supply apparatus, and wherein the first removal conveyor conveys the discarded product parts to a discarding device provided after the first removal conveyor;

wherein the second removal conveyor is a single track conveyor; and a track combiner configured to take over the respective slices from the first removal conveyor and transfer and place them on the second removal conveyor;

wherein the track combiner is positioned between the first removal conveyor and the second removal conveyor, and bridges over the discarding device;

wherein the track combiner is a deflection conveyor whose conveying width is smaller than a conveying width of a conveyor track of the first removal conveyor and whose end adjacent to the first removal conveyor is displaceable transversely to the transport direction;

wherein the track combiner comprises a fixed-position roller and a displaceable roller.

2. The slicing apparatus in accordance with claim 1, wherein the track combiner is a multi-belt conveyor having a plurality of individual conveyor belts.

3. The slicing apparatus in accordance with claim 2, wherein the fixed-position roller is a deflection roller and is disposed at an outgoing side adjacent to the second removal conveyor and the displacement roller is a drive roller adjacent to the first removal conveyor and displaceable transversely to the transport direction.

4. The slicing apparatus in accordance with claim 1, wherein the discarding device extends, viewed transversely to the transport direction, at least substantially across all conveyor tracks of the first removal conveyor.

5. The slicing apparatus in accordance with claim 1, wherein a length of the discarding device is greater than a length of the slices with respect to the transport direction.

6. The slicing apparatus in accordance with claim 1, wherein the first removal conveyor has two conveyor tracks.

7. A method for the continuous slicing of products, the method comprising the steps of:

providing the slicing apparatus of claim 1;

supplying the products on the two-track supply apparatus to convey the products to the at least one slicing unit to cut off the products into slices and discarded product parts;

transferring the slices and the discarded product parts away from the at least one slicing unit by the first removal conveyor;

transferring the discarded product parts to the discarding device located between the first removal conveyor and the second removal conveyor;

taking over the slices on the first removal conveyor consecutively in time by the track combiner; and transferring and placing the slices on the second removal conveyor by the track combiner.

8. The method in accordance with claim 7, wherein, during the slicing of a first product on one of the tracks of the two-track supply apparatus, another track is loaded with a second product, with a start end of the second product being cut off before the first product is completely sliced.

9. The method in accordance with claim 8, wherein the start end of the second product is sliced into discarded product parts by the at least one slicing unit, with the slicing of the start end of the second product being started when the number of remaining slices of the first product equals the number of discarded product parts of the start end of the second product.

* * * * *